US011054230B1

(12) United States Patent
Pines et al.

(10) Patent No.: US 11,054,230 B1
(45) Date of Patent: Jul. 6, 2021

(54) FLEXIBLE ANTI-PERSONNEL MINE

(71) Applicant: The United States of America as Represented by the Secretary of the Navy, Indian Head, MD (US)

(72) Inventors: Daniel Corey Pines, Alexandria, VA (US); Alexander Sweeney, Washington, DC (US); Taylor Young, Alexandria, VA (US); Steven Dunham, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/998,022

(22) Filed: Jun. 14, 2018

(51) Int. Cl.
*F42B 23/10* (2006.01)
*F42B 12/32* (2006.01)
*F42B 23/24* (2006.01)

(52) U.S. Cl.
CPC ..... *F42B 23/10* (2013.01); *F42B 12/32* (2013.01); *F42B 23/24* (2013.01)

(58) Field of Classification Search
CPC ..... F24B 23/00; F24B 23/04; F24B 23/08; F24B 23/24; F24B 23/10; F24B 12/32
USPC ..... 102/401, 424
See application file for complete search history.

(56) References Cited

U.S. PATENT DOCUMENTS

| | | | | |
|---|---|---|---|---|
| 2,972,949 A | 2/1961 | MacLeod | | |
| 3,970,005 A | 7/1976 | Rothman | | |
| 4,391,198 A * | 7/1983 | Auge | F42B 23/04 | 102/401 |
| 5,003,885 A * | 4/1991 | Rudolf | F42B 12/32 | 102/475 |
| 8,950,332 B1 * | 2/2015 | Iden | F42B 12/60 | 102/498 |
| 9,341,454 B1 | 5/2016 | Strandberg et al. | | |
| 2008/0156220 A1 * | 7/2008 | Tanguy | F42B 12/24 | 102/482 |

FOREIGN PATENT DOCUMENTS

| | | | |
|---|---|---|---|
| WO | WO-9412848 A1 * | 6/1994 | F42B 10/50 |

* cited by examiner

*Primary Examiner* — Troy Chambers
*Assistant Examiner* — Benjamin S Gomberg
(74) *Attorney, Agent, or Firm* — Fredric J. Zimmerman

(57) ABSTRACT

An anti-personnel mine that is flexible for manipulation in the field to accommodate missions by changing the shape of the C-4. The mine includes M112 seated in and adhered to a flexible housing having a rear involute wall. The involute wall includes a set of projecting folded pair of inclined walls that are about equidistant between a pair of inclined end walls. The inclined walls partitions most, but not all of the thickness of the M112 into segments that are tapered and accommodate the inclined walls. A metal spine, which may be shaped, is adhered to the front surface of the M112. Fragmentation elements and a bottom side of an elastic membrane are adhered to the spine and the front surface of the M112.

13 Claims, 7 Drawing Sheets

FLEXIBLE ANTI-PERSONNEL MINE

STATEMENT OF GOVERNMENT INTEREST

The invention described herein may be manufactured and used by or for the Government of the United States of America for Governmental purposes without the payment of any royalties thereon or therefore.

FIELD OF THE INVENTION

The invention relates generally to shaped charges and more particularly to an anti-personnel mine having a shaped charge that can be manipulated in the field to have various shapes including a V shape, a closed C shape, an open C shape, a w shape, and a twisted (torsional) shape.

BACKGROUND OF THE INVENTION

Conventional art teaches what are now known as Claymore mines. Conventional art teaches that Claymore mines are directional anti-personnel mines, unlike conventional land mines, and are command-detonated and directional. Nominally, a Claymore mine is fired by remote-control and has a shaped charge with fixed dimensions that, when detonated, generate a fixed directional blast of shrapnel. The fixed directional blast is defined as having a scope with a horizontal arc of from 45° to 90° and a vertical arc of from 10° to 30°. The dimensions of the interior of the housing, which is fixed, substantially determine the dimensions of the shaped charge.

For a given explosive force and type of shrapnel or fragmentation, the narrower the horizontal and vertical arcs, the more concentrated the directional blast of shrapnel. Furthermore, the more focused is the directional blast, then for a given type of shrapnel, the more lethal is the directional anti-personnel mine. In the embodiments of the conventional art, there is a horizontal spread of 50° to 60° and the vertical spread is about 20°, which is significantly narrower in scope than the full range, and would be highly lethal. The side walls and the upper and lower walls of the interior of the housing are all curved outward, such that the fixed directional blast is focused to a relatively narrow scope.

SUMMARY OF THE INVENTION

The invention is a flexible anti-personnel mine that may be manipulated in the field to have various shapes including a V shape, a closed C shape, an open C shape, a w shape, and a twisted (torsional) shape. Prior to manipulation it is substantially a rectangular block, where the rectangular block includes a thick layer of an explosive having a front surface to which is laminated a bendable metal spine that has a backbone with a plurality of orthogonal lateral substantially straight ribs. Laminated to the spine and a periphery of the frontal surface of the explosive is a membrane of a flexible polymer. The membrane is embedded with a plurality of fragmentation elements, for example fragmentation balls or shards.

The flexible anti-personnel mine further includes a flexible housing for the explosive where the flexible housing has a rear involute wall with a set of projecting folded pair of inclined walls that are positioned about equidistant between a pair of inclined end walls. A rear surface of the explosive has an opposing set of receiving perforations.

An aspect of the invention is that it may be manipulated to function similar to the Claymore anti-personnel mine, with the added benefit of being able to be reshaped, therein changing its anti-personnel characteristics.

A second aspect of the invention is that the explosive may be initiated by a blasting cap or a laser ordnance initiator, and detonated by a detonator selected from the group consisting of: an ordinary detonator, an electrical detonator, a non-electric detonator, and an electronic detonator.

A third aspect of the invention is that the spine is made of a metal that when bent it retains the bend, such that when the flexible anti-personnel mine is manipulated into a new shape it assumes the new shape.

A final aspect of the invention is that the explosive is prepackaged, wrapped in a film, where a rear surface of the explosive has a pressure sensitive adhesive layer.

BRIEF DESCRIPTION OF THE DRAWINGS

The foregoing invention will become readily apparent by referring to the following detailed description and the appended drawings in which:

FIG. 1*a* is an enlarged cross-sectional side view of FIG. 1, illustrating the membrane with an embedded ball;

DETAILED DESCRIPTION OF THE INVENTION

The invention is a flexible anti-personnel mine having a shaped charge that can be manipulated in the field to have various shapes.

Figure 4A:
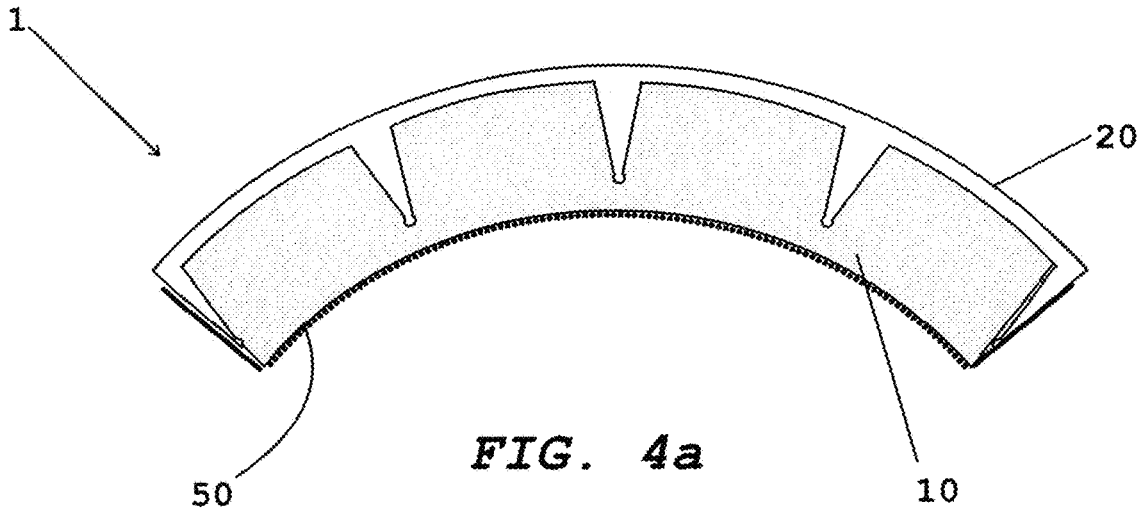
FIG. 4*a* is an overhead plan view of the flexible anti-personnel mine manipulated into a closed C shape.
Figure 4B:
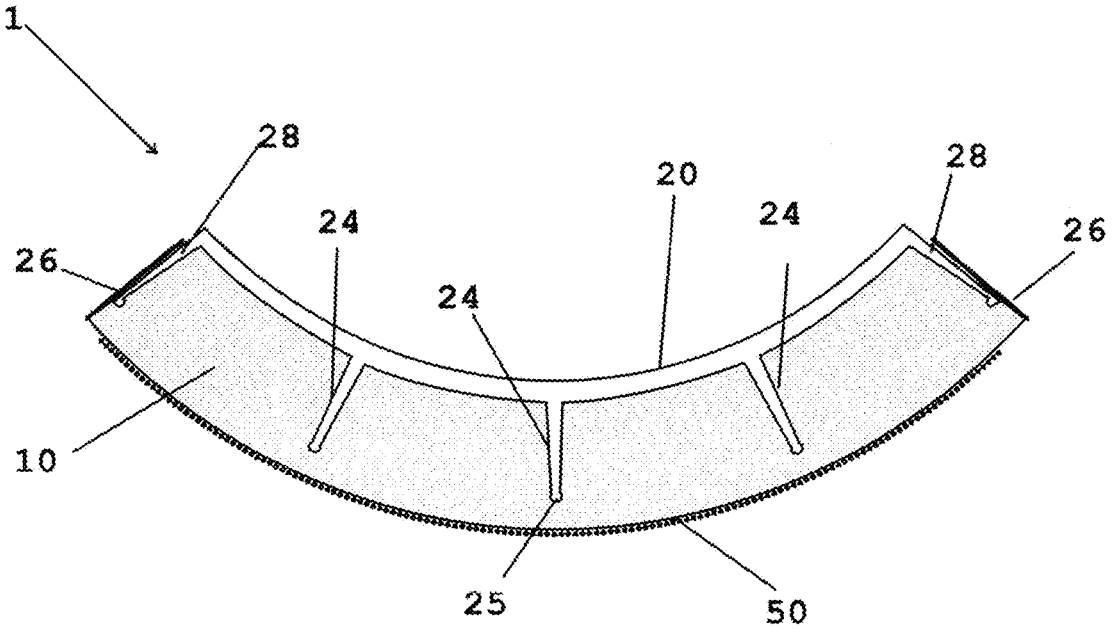
FIG. 4*b* is an overhead plan view of the flexible anti-personnel mine manipulated into an open C shape.
Figure 4C:
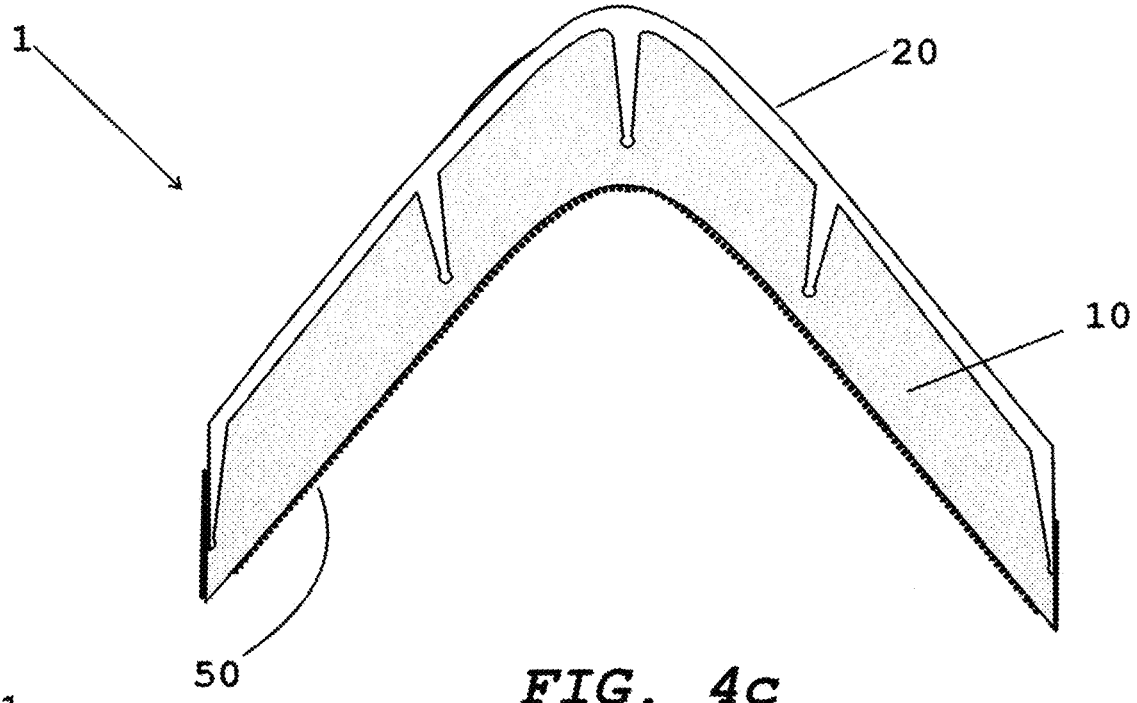
FIG. 4*c* is an overhead plan view of the flexible anti-personnel mine manipulated into a closed V shape.

An advantage of being able to manipulate the anti-personnel mine is that in the field its characteristic may be changed to affect a tactical plan for a mission. For example to maximize lethalness, the anti-personnel mine may be configured to have the highest concentration of fragments. The closed C shape in FIG. 4*a* and the V shape in FIG. 4*c* generate the highest concentration of fragments. The V shape has a slightly higher concentration, but it is less uniform than the closed C shape. In contrast, the open C shape in FIG. 4*b* and the twisted (torsional) shape in FIG. 4*e* have the lowest concentration. A combination of mines may be used to move an enemy from an area using mines having a low concentration of fragments to an area where the mines have a high concentration of fragments.

Figure 4D:
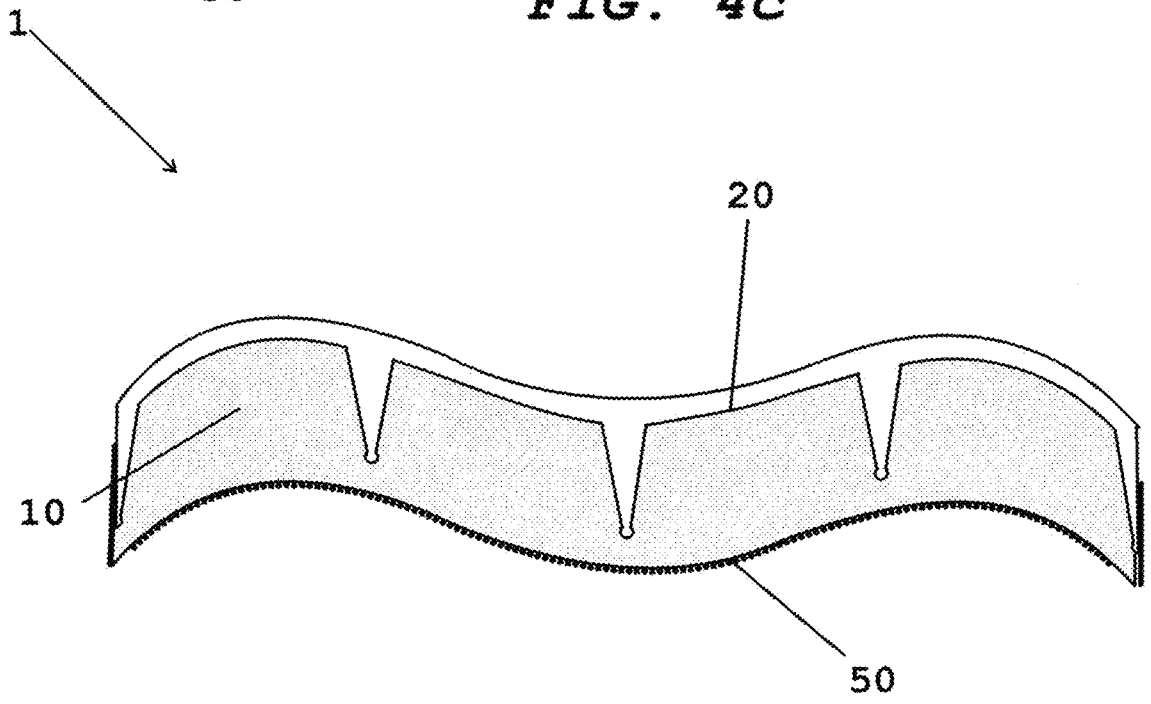
FIG. 4*d* is an overhead plan view of the flexible anti-personnel mine manipulated into a closed W shape.
Figure 4E:
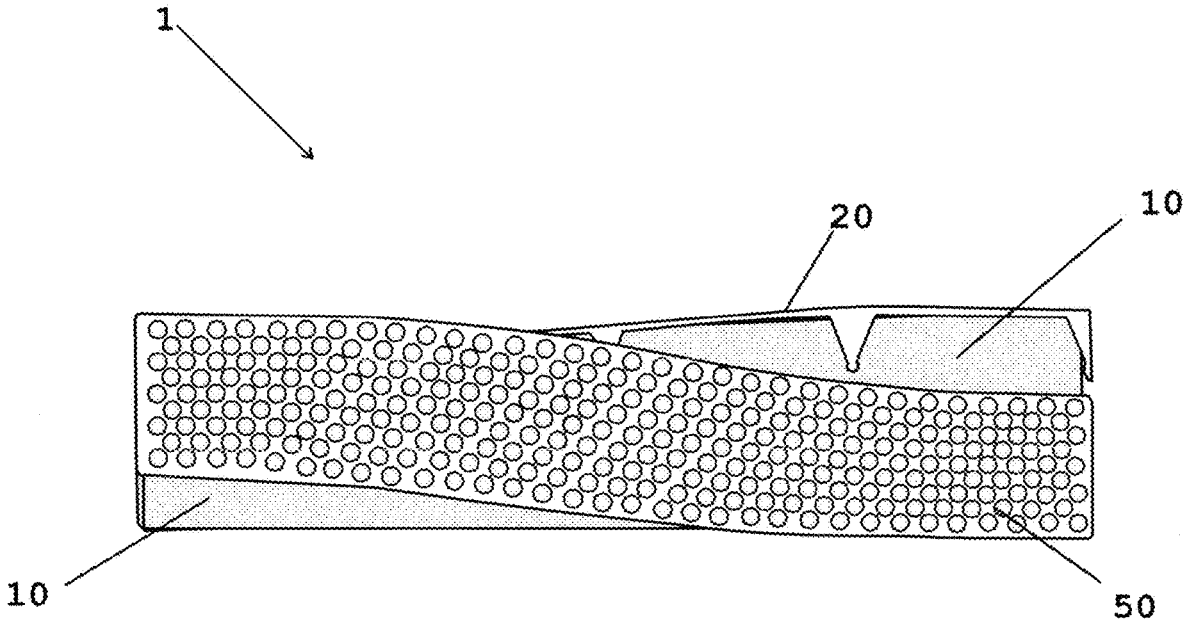
FIG. 4*e* is an overhead plan view of the flexible anti-personnel mine manipulated into a twisted (torsional) shape.

If deterrence is the tactic, then the w shape in FIG. 4*d* and/or the twisted (torsional) shape would be more effective, as these shapes are less lethal, but still lethal enough to deter soldiers from a field armed with anti-personnel mine. The specific mine or combination of mines can depend on many factors, and the ability to change the characteristics of the anti-personnel mine while in the field is a distinct advantage of the invented antipersonnel mine.

In an exemplary embodiment, the explosive is prepackaged C-4, known to military personnel as M112. Military grade C-4 is commonly packaged as a demolition charge M112. The demolition charge M112 is a rectangular block of composition C-4. The block of explosive is about 2 inches wide by about 1.5 inches thick and about 11 inches long, weighing about 1.25 lbs. (about 0.57 kg). The thickness is about 13.6%±about 3% of the length.

The M112 rectangular block of C-4 is wrapped in a film, generally, in an exemplary embodiment, an olive color Mylar® film made by DuPont, with a pressure-sensitive adhesive tape on one surface. The pressure-sensitive adhesive tape typically is covered by a release liner.

The M112 demolition blocks of C-4 are commonly manufactured into the M183 "demolition charge assembly", which consists of 16 M112 block demolition charges and four priming assemblies packaged inside military Carrying Case M85. The M183 is used to breach obstacles or demolish large structures where larger satchel charges are required. Each priming assembly includes a five- or twenty-foot length of detonating cord assembled with detonating cord clips and capped at each end with a booster. When the charge is detonated, the explosive is converted into compressed gas. The gas exerts pressure in the form of a shock wave, which demolishes the target by cutting, breaching, or cratering. Similarly, the invented flexible anti-personnel mine 1 can also be detonated, by in lots of only one block of M112.

Figure 1:
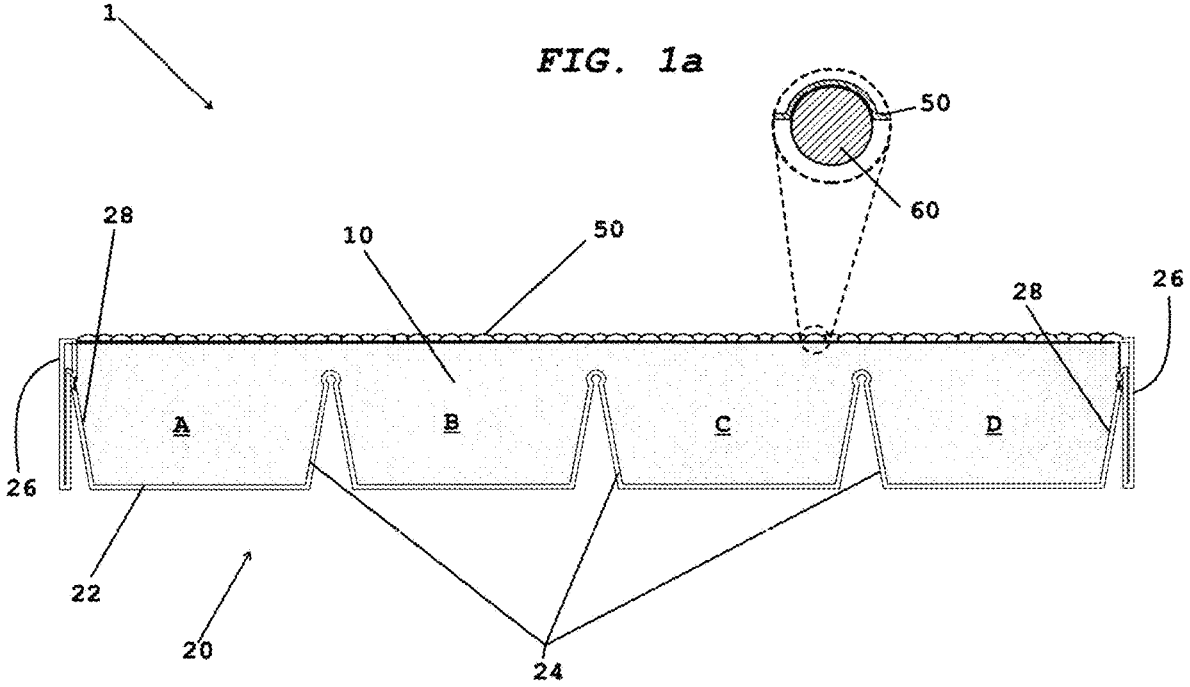
FIG. 1 is a side plan view of the flexible anti-personnel mine.

The invented flexible anti-personnel mine 1 is shown in FIG. 1 prior to any manipulation.

In this view, the rectangular block of explosive 10 is shown to be malleable enough to be pushed down into a flexible housing 20. The flexible housing has a rear involute wall 22 with a set of projecting folded pair of inclined walls 24 that are positioned about equidistant between a pair of inclined end walls 28 having a flange 26. The inclined end walls 28 are contiguous with the rear involute wall 22. The inclined end walls 28 and the projecting folded pair of inclined walls 24 partition most of the rectangular block of explosive 10 into four segments A, B, C, D; wherein each segment is tapered.

Each inclined wall of the set of projecting folded pair of inclined walls and the pair of inclined end walls is initially inclined about 12 degrees±about 3 degrees from perpendicular to the rear involute wall. The incline is discussed in detail later.

Also shown in FIG. 1 and FIG. 1*a* is a membrane 50 embedded with a plurality of fragmentation elements. In the illustrated embodiment the fragmentation elements are balls 60. There are about 240±about 40 balls on the front surface of the mine, which as previously described the block of explosive is about 2 inches wide by about 1.5 inches thick and about 11 inches long. Each ball 60 has a diameter of about 0.25 inches±about 0.13 inches. In an exemplary embodiment, the balls are nominally composed of a metal. In an alternate exemplary embodiment, plastic and rubber balls also may be used. It is anticipated that paint balls may be used to simulate the invented flexible anti-personnel mine 1.

The membrane has a thickness of about 0.01 inches±about 0.013 inches, and is composed of an elastic polymer. In an exemplary embodiment, a membrane material is a two part silicone. As shown in FIG. 1*a* the fragmentation balls 60 are not completely enclosed by the membrane 50.

Figure 2:
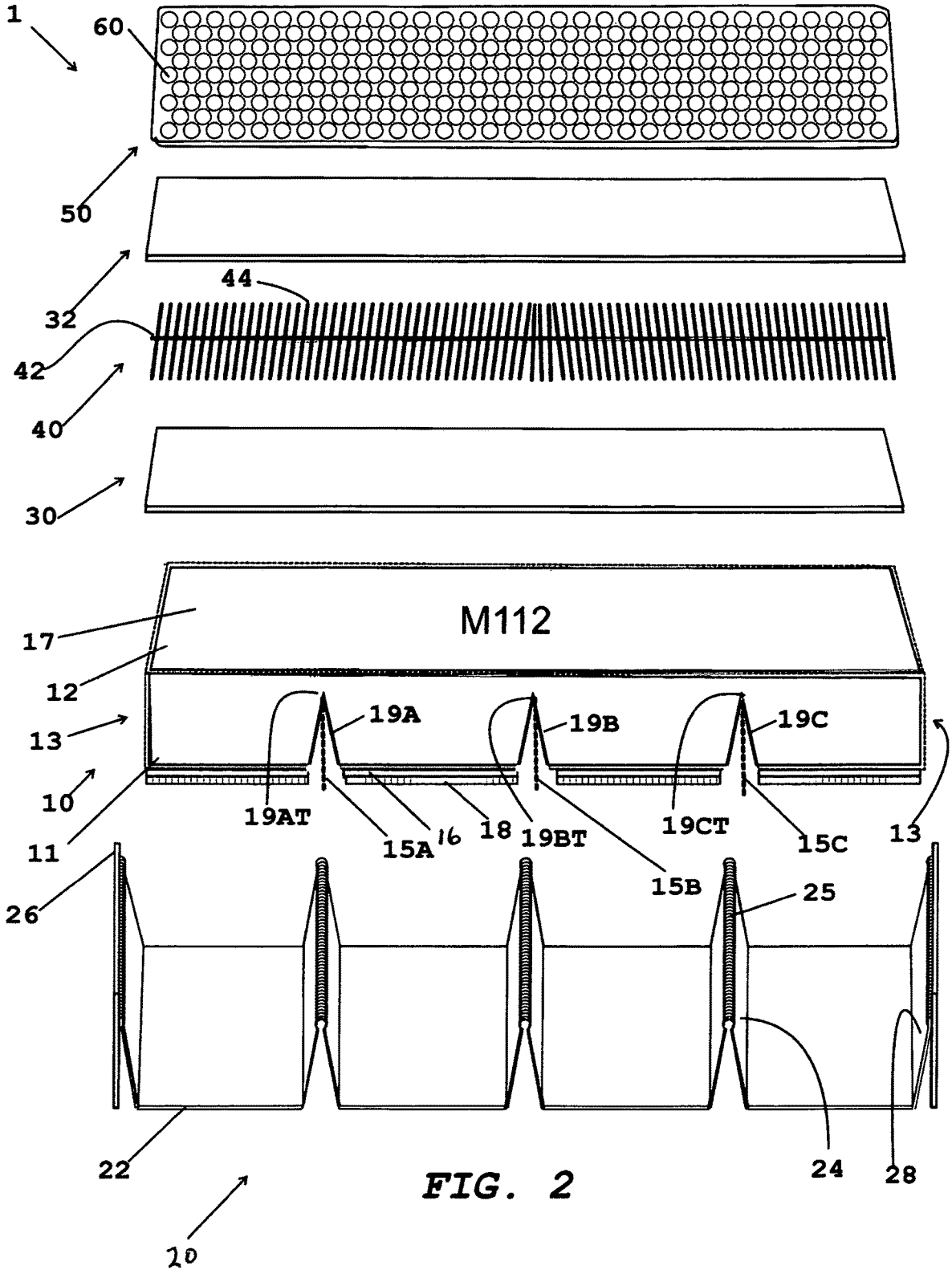
FIG. 2 is an elevated exploded view of the flexible anti-personnel mine shown in FIG. 1.

The flexible anti-personnel mine 1 shown in FIG. 1 is shown in an elevated exploded view in FIG. 2. The explosive 10 is M112, a rectangular block of C-4 wrapped in a film, such as the polyester film known as Mylar™, which is a DuPont product. A bottom surface 11 of the rectangular block 10 has a pressure sensitive adhesive 16 covered with a release liner 18.

In preparing the M112 10 to be pushed down into the flexible housing 20, the M112 10 was malleable enough to be pushed down on the inclined walls forming a set of receiving perforations 19A, 19B and 19C. Optionally, the film may be cut at 15A, 15B and 15C, making it easier to deform the explosive.

Each projecting folded pair of inclined walls 24 terminates in a hairpin end 25, which is slid to an apex 19AT, 19BT and 19CT of the receiving perforation 19A, 19B and 19C. The release liner 18 is then removed and the pressure sensitive adhesive 16 is pressed against the bottom 22 the flexible housing 20. The ends 13 of the M112 rectangular block 10 are supported by the inclined end walls 28 and the flanges 26 of the flexible housing 20.

Figure 3A:
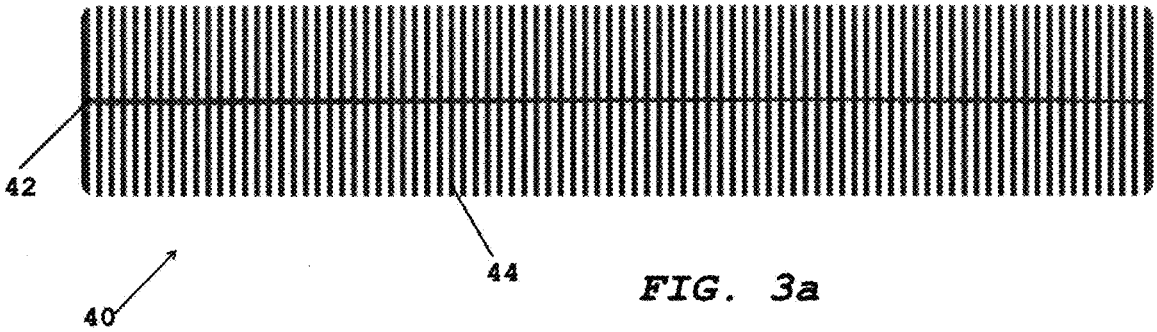
FIG. 3*a* is an overhead plan view of the spine illustrated in FIG. 2.
Figure 3B:
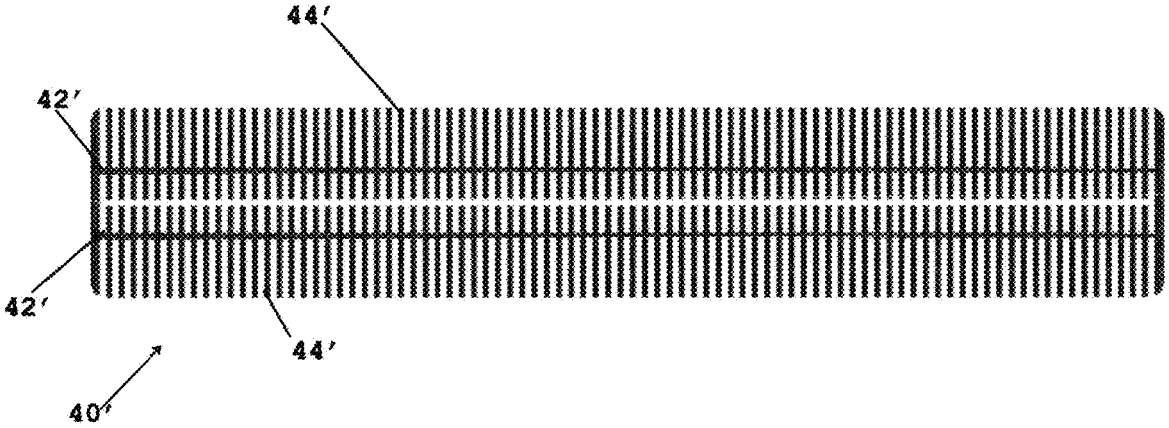
FIG. 3*b* is an overhead plan view of another spine, wherein the backbone has a ladder-like configuration.

In FIGS. 2 and 3*b*, a spine 40 includes a backbone 42 with a plurality of orthogonal lateral substantially straight ribs 44. The spine 40 is generally cut from a sheet of metal that has a thickness in the range of about 0.035 inches to about 0.081 inches. Known effective cutting methods include water jet, laser and plasma cutting. Water jet, unlike laser and plasma cutting, has no material hardening. Therefore, water jet is an exemplary cutting method as hardening is not desired.

The metal sheet for the spine 40 is a metal that when bent remains bent, such that when the flexible anti-personnel mine is manipulated into a shaped charge, the shape is retained. Coat hanger wire is an exemplary metal. Suitable exemplary metals are sott iron, copper, aluminum, low carbon steels, brass, and combinations thereof. Coat hanger wire is typically made of low carbon steel. Certain grades of lead could work, but tend to be too soft, and possibly toxic. A high carbon iron and heat treated steels tend to more springy, and therefore unsuitable.

In the exemplary embodiment illustrated in FIG. 2, the spine 40 has a single backbone and a plurality of orthogonal lateral substantially straight ribs 44. The illustrated plurality is about 110 ribs±about 30 ribs. The spine 40 reinforces substantially the length and width of the M112 rectangular block 10. A first adhesive layer 30 adheres the spine 40 to the front surface 17 of the rectangular block of explosive 10. A suitable first adhesive layer is a two part epoxy, as it provides very good adhesion. If a heavy coating of the adhesive is applied an additional adhesive layer is not required.

The plan view of the spine 40 shown in FIG. 2 also is shown in FIG. 3*a*. A spine 40' having two backbones 42' is shown in FIG. 3*b*, where substantially all the ribs 44' are paired. This ladder-like configuration has roughly twice the resistance against bending in and out a plane of the paper, but not much more resistance to twisting, as the two backbones 42' have only two connecting ribs that connect the two backbones 42' (see first rib and last rib). Otherwise, the individual ribs 44' are shorter and therefore stronger, making spine 42' highly suited for manipulating it into a V shape, as shown in FIG. 4*c*.

In the illustration, a second adhesive layer 32 of a two part epoxy is used to secure the fragmentation balls 60 and the membrane 50 to the spine 40. The membrane's function is substantially to facilitate the positioning of the fragmentation balls 60 during assembly, and the membrane extends to from one flange 26 to another flange 26 on the flexible housing. The second layer 32 of cured epoxy as shown in FIG. 2 provides most of the adhesion, via the fragmentation balls.

Figure 5A:
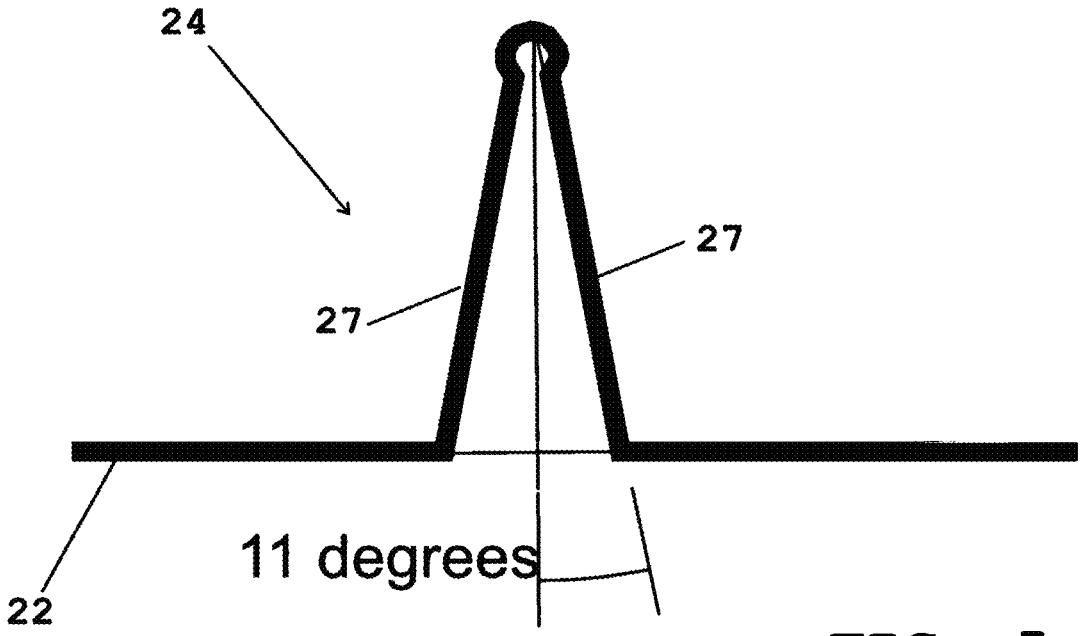
FIG. 5*a* is an enlarged view of a projecting folded pair of inclined walls that are not bent.
Figure 5B:
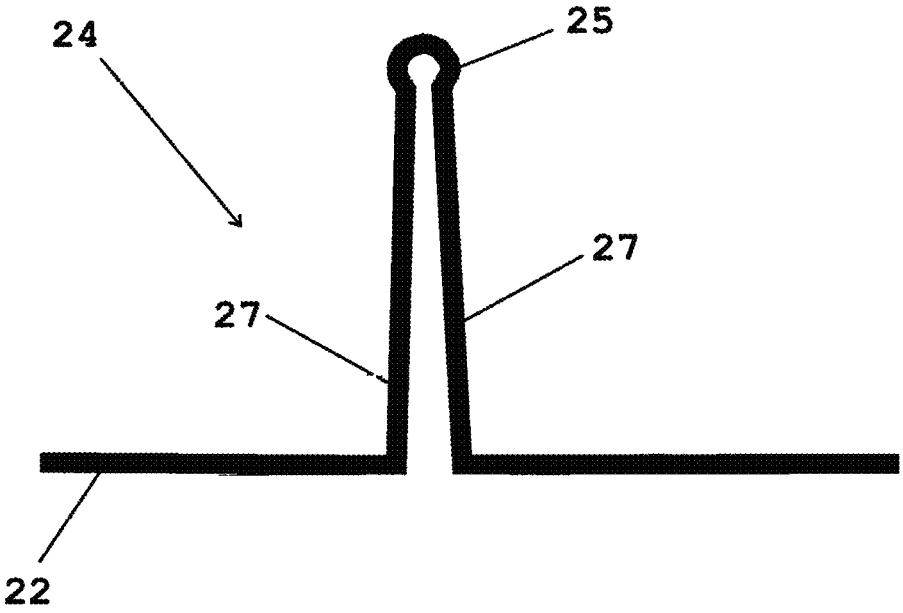
FIG. 5*b* is an enlarged view of a projecting folded pair of inclined walls after the flexible anti-personnel mine has been bent into the open C shape, as shown in FIG. 4*b*.

For the flexible housing 20 of the flexible anti-personnel mine 1 supporting the rectangular block of explosive 10 to be bent to an open C shape as shown in FIG. 4*b*. Prior to bending the set of projecting folded pair of inclined walls 24 must have an angle of incline that may accommodate movement of the walls 24 to be about perpendicular to the rear involute wall. The rear involute wall 22 is under compression, so it will not stretch. Before being bent, a projecting side inclined wall 27 of the projecting folded pair of inclined walls 24 is about eleven degrees from perpendicular, as shown in FIG. 5*a*, and more specifically about 11.25 degrees. There are six projecting side inclined walls 27 and two inclined end walls 28, each capable of pivoting around the hairpin end 25 about 11.25 degrees, for a total of about ninety degrees. FIG. 5*b* illustrates a projecting folded pair of inclined walls 24 after manipulation to the open C shape, wherein the flexible anti-personnel mine is bent 90 degrees.

The flexible housing 20 may be made of any suitably flexible material. In trials, the flexible housing 20 has been made using 3D printing using a UV light curable methacrylate composition. Many other relatively resilient cured elastomeric materials are anticipated to be suitable. There are many curable rubbery materials that may be demolded that will work. Frangible materials will not work because they tend to break rather than bend.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. An anti-personnel mine, comprising:

a rectangular block of explosive including a front surface and a rear surface having a length, a width, and a thickness that is about 13.6%±about 3% of the length, wherein said rectangular block of explosive is seated in and adhered by a rear surface adhesive to a flexible housing, wherein the flexible housing has a rear involute wall with a set of projecting folded pair of inclined walls that are about equidistant between a pair of inclined end walls, wherein the projecting folded pair of inclined walls partitions most of the thickness of said rectangular block of explosive into segments, and wherein the segments are tapered and malleable enough to accommodate the projecting folded pair of inclined walls and the pair of inclined end walls; and a metal spine including at least one backbone with a plurality of orthogonal lateral ribs, wherein the metal spine is adhered by a first layer of adhesive to the front surface of the rectangular block of explosive, wherein fragmentation elements and a bottom side of an elastic membrane are adhered by a second layer of adhesive to the spine and the front surface of the rectangular block of explosive, and wherein said first layer of adhesive and said second layer of adhesive are a two part epoxy adhesive.

2. An anti-personnel mine, comprising:

a rectangular block of explosive including a front surface and a rear surface having a length, a width, and a thickness that is about 13.6%±about 3% of the length, wherein said rectangular block of explosive is seated in and adhered by a rear surface adhesive to a flexible housing, wherein the flexible housing has a rear involute wall with a set of projecting folded pair of inclined walls that are about equidistant between a pair of inclined end walls, wherein the projecting folded pair of inclined walls partitions most of the thickness of said rectangular block of explosive into segments, and wherein the segments are tapered and malleable enough to accommodate the projecting folded pair of inclined walls and the pair of inclined end walls; and a metal spine including at least one backbone with a plurality of orthogonal lateral ribs, wherein the metal spine is adhered by a layer of adhesive to the front surface of the rectangular block of explosive, wherein fragmentation elements and a bottom side of an elastic membrane are adhered to the spine and the front surface of the rectangular block of explosive, and wherein the rectangular block is a demolition charge M112 rectangular block comprised of C-4 explosive.

3. An anti-personnel mine, comprising:

a rectangular block of explosive including a front surface and a rear surface having a length, a width, and a thickness that is about 13.6%±about 3% of the length, wherein said rectangular block of explosive is seated in and adhered by a rear surface adhesive to a flexible housing, wherein the flexible housing has a rear involute wall with a set of projecting folded pair of inclined walls that are about equidistant between a pair of inclined end walls, wherein the projecting folded pair of inclined walls partitions most of the thickness of said rectangular block of explosive into segments, and wherein the segments are tapered and malleable enough to accommodate the projecting folded pair of inclined walls and the pair of inclined end walls; and a metal spine including at least one backbone with a plurality of orthogonal lateral ribs, wherein the metal spine is adhered by a layer of adhesive to the front surface of the rectangular block of explosive, and wherein fragmentation elements and a bottom side of an elastic membrane are adhered to the spine and the front surface of the rectangular block of explosive.

4. The anti-personnel mine according to claim 3, wherein said rectangular block of explosive comprises C-4 explosive wrapped in a packaging film, and wherein said rectangular block includes a pressure sensitive adhesive covered with a release liner on a filmic rear surface.

5. The anti-personnel mine according to claim 3, wherein said metal spine and said rear involute wall enable the anti-personnel mine to be manipulated to various shapes, wherein the various shapes of the anti-personnel mine include a V shape, a closed C shape, an open C shape, a w shape, and a twisted, torsional shape, and wherein the shapes determine fragmentation.

6. The anti-personnel mine according to claim 5, wherein the V shape and the closed C shape are combined to form a trajectory, which concentrates the fragmentation elements.

7. The anti-personnel mine according to claim 5, wherein the open C shape forms a trajectory that disperses the fragmentation elements, making the anti-personnel mine less lethal.

8. The anti-personnel mine according to claim 3, wherein said elastic membrane is a two part polymeric silicone.

9. The anti-personnel mine according to claim 3, wherein said fragmentation elements are balls selected from the group consisting of at least one of shards, metal balls, plastic balls, rubber balls, and paint balls.

10. The anti-personnel mine according to claim 3, wherein each inclined wall of said set of projecting folded pair of inclined walls and the pair of inclined end walls is initially inclined about 12 degrees±about 3 degrees from perpendicular.

11. The anti-personnel mine according to claim 3, wherein said metal spine is made of a metal selected from the group consisting of at least one of soft iron, copper, aluminum, low carbon steels, and brass.

12. The anti-personnel mine according to claim 3, wherein the front surface and the rear surface each includes a length of about 11 inches, a width of about 2 inches, and a thickness of about 1.5 inches.

13. The anti-personnel mine according to claim 3, wherein the rectangular block has a weight of about 1.25 pounds.

* * * * *